US009920768B2

(12) United States Patent
Bruss et al.

(10) Patent No.: US 9,920,768 B2
(45) Date of Patent: Mar. 20, 2018

(54) CENTRIFUGAL FAN ASSEMBLY

(71) Applicant: Deere & Company, Moline, IL (US)

(72) Inventors: Paul T. Bruss, Cedar Falls, IA (US); Jason M. Edgington, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 348 days.

(21) Appl. No.: 14/669,589

(22) Filed: Mar. 26, 2015

(65) Prior Publication Data

US 2016/0281730 A1 Sep. 29, 2016

(51) Int. Cl.
*F01D 5/14* (2006.01)
*F04D 29/28* (2006.01)

(52) U.S. Cl.
CPC ..... *F04D 29/281* (2013.01)

(58) Field of Classification Search
CPC ..... F04D 29/281; F04D 29/66; F04D 29/666; F04D 29/284; F04D 29/663; F04D 29/30; F01D 5/146
See application file for complete search history.

(56) References Cited

U.S. PATENT DOCUMENTS 4,093,401 A * 6/1978 Gravelle ..... F04D 29/284 415/143
5,213,473 A * 5/1993 Fiala ..... F01D 5/048 416/183
6,450,765 B1 9/2002 Carroll et al.
7,300,244 B2 11/2007 Baugh et al.
7,585,154 B2 9/2009 Lan et al.
7,726,142 B2 6/2010 Keen
8,997,486 B2 * 4/2015 Hall ..... F04D 25/024 416/183

FOREIGN PATENT DOCUMENTS

WO WO 9002265 A1 * 3/1990 ..... F01D 5/048

OTHER PUBLICATIONS

Deere & Company, Fan Geometry and HVAC Module Static Pressure (2 pages), date not known, but used in production design before the invention of the present invention.

* cited by examiner

*Primary Examiner* — Logan Kraft
*Assistant Examiner* — Jason Fountain
(74) *Attorney, Agent, or Firm* — Taft Stettinius & Hollister LLP; Stephen F. Rost

(57) ABSTRACT

A centrifugal fan assembly includes an impeller assembly which has a fixed stator and a rotating impeller having a base plate, a hub connected to the base plate a plurality of backward curved first blades, and a plurality of backward curved second blades. Each first blade has an inner end which is connected to the hub. Each second blade has an inner end which is spaced apart from the hub and which tapers to a point. The first and second blades have different profiles or shapes. The axial length of the first blades is different from the axial length of the second blades. Each second blade forms an apex which projects axially from the base plate.

12 Claims, 8 Drawing Sheets

CENTRIFUGAL FAN ASSEMBLY

TECHNICAL FIELD

The present disclosure relates to a fan assembly for a heating, ventilation and air conditioning (HVAC) system for a vehicle cab.

BACKGROUND

Operator stations or cabs of most agricultural vehicles are surrounded by large areas of glass so that the operator can see the area being worked or the product being produced or harvested. These large glass surface areas transmit a lot of light and result in a significant solar heat load being applied through the glass surfaces into the cab. This solar heat load along with engine cooling heat and exhaust heat in proximity to the operator station must be overcome by the cab HVAC system.

Such an HVAC system is described in U.S. Pat. No. 7,726,142, issued on 1 Jun. 2010 and assigned to the assignee of the present application. This system includes a centrifugal fan with backward curved blades which propel air through a series of heat exchangers in order to condition the air. It is desired to provide a fan for such a system which is quieter.

SUMMARY

According to an aspect of the present disclosure, an impeller includes a base plate, a hub connected to the base plate and having a rotation axis, a plurality of first blades disposed on the base plate, and a plurality of second blades disposed on the base plate. The base plate has a circular outer peripheral edge. The base plate has a curved first plate surface which is joined to the surface of the hub, and a flat second plate surface opposite the first plate surface. The first and second blades project from the first surface.

Each of the first blades is spaced apart and positioned between a corresponding pair of second blades. Each first bade has an inner end connected to the hub and having a first inner axial length. Each first bade has an outer end spaced apart from the hub and having a first outer axial length which is less than the first inner axial length. Each second blade has an inner end which is spaced apart from the hub. Each second bade also has an outer end spaced apart from the hub. The second bade outer end and has a second outer axial length which is greater than the first outer axial length.

Each second blade has an inner end which tapers to a tip connected to the base plate. The outer ends of the first and second blades are aligned with the outer peripheral edge. Each second blade has a mid location which is between the inner and outer ends thereof. The inner end of each first blade has an upstream corner which is spaced apart axially from the second plate surface by a first inner length. Each second blade has a mid location which is between the inner end and outer ends thereof. Each mid location forms an apex which is spaced apart axially from the second plate surface by an apex axial length. The first inner axial length is greater than said apex axial length.

DETAILED DESCRIPTION OF THE DRAWINGS

At least one example embodiment of the subject matter of this disclosure is understood by referring to FIGS. 1 through 7 of the drawings.

Figure 1:
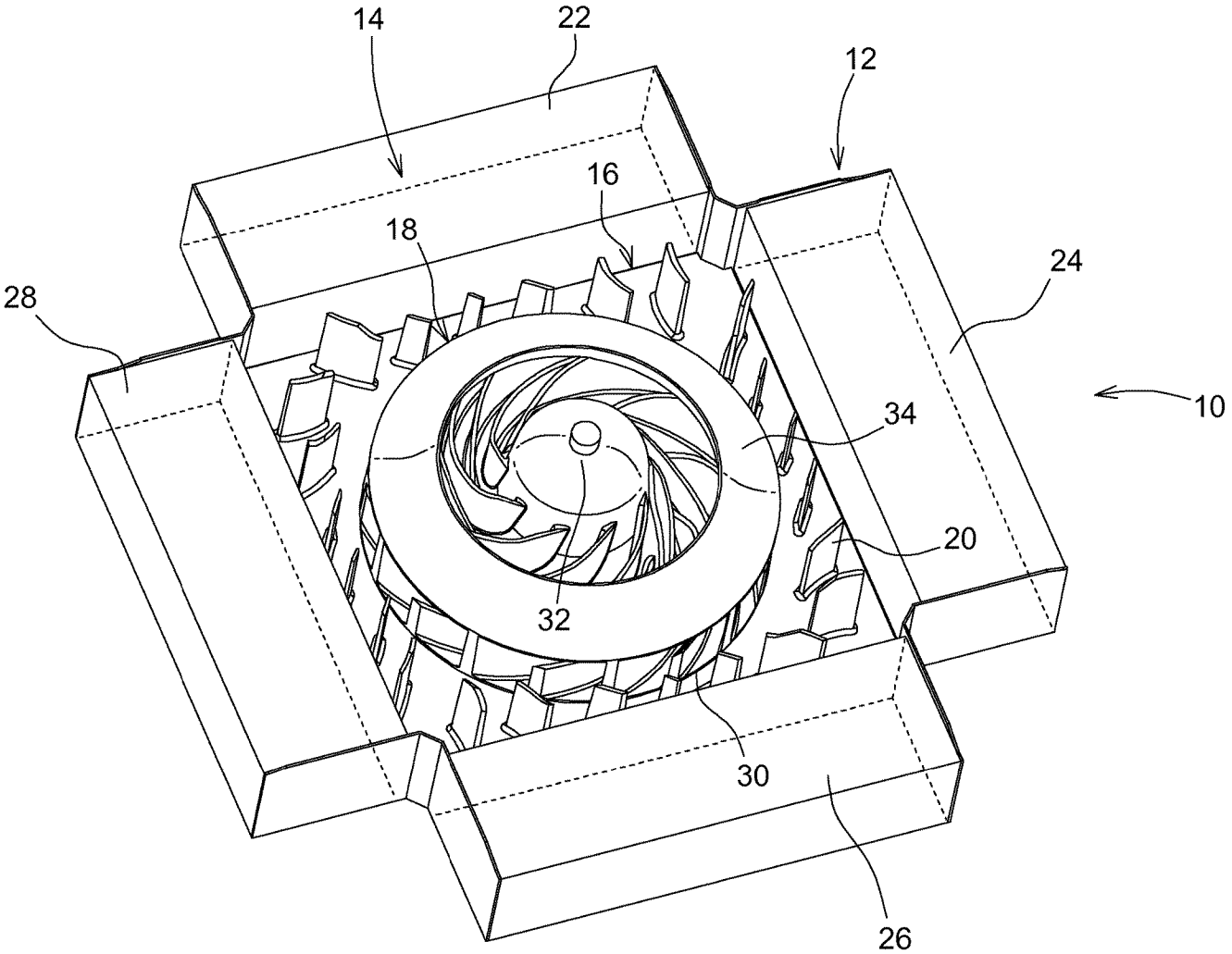
FIG. 1 is a bottom perspective view of a fan or impeller assembly embodying the invention.
Figure 2:
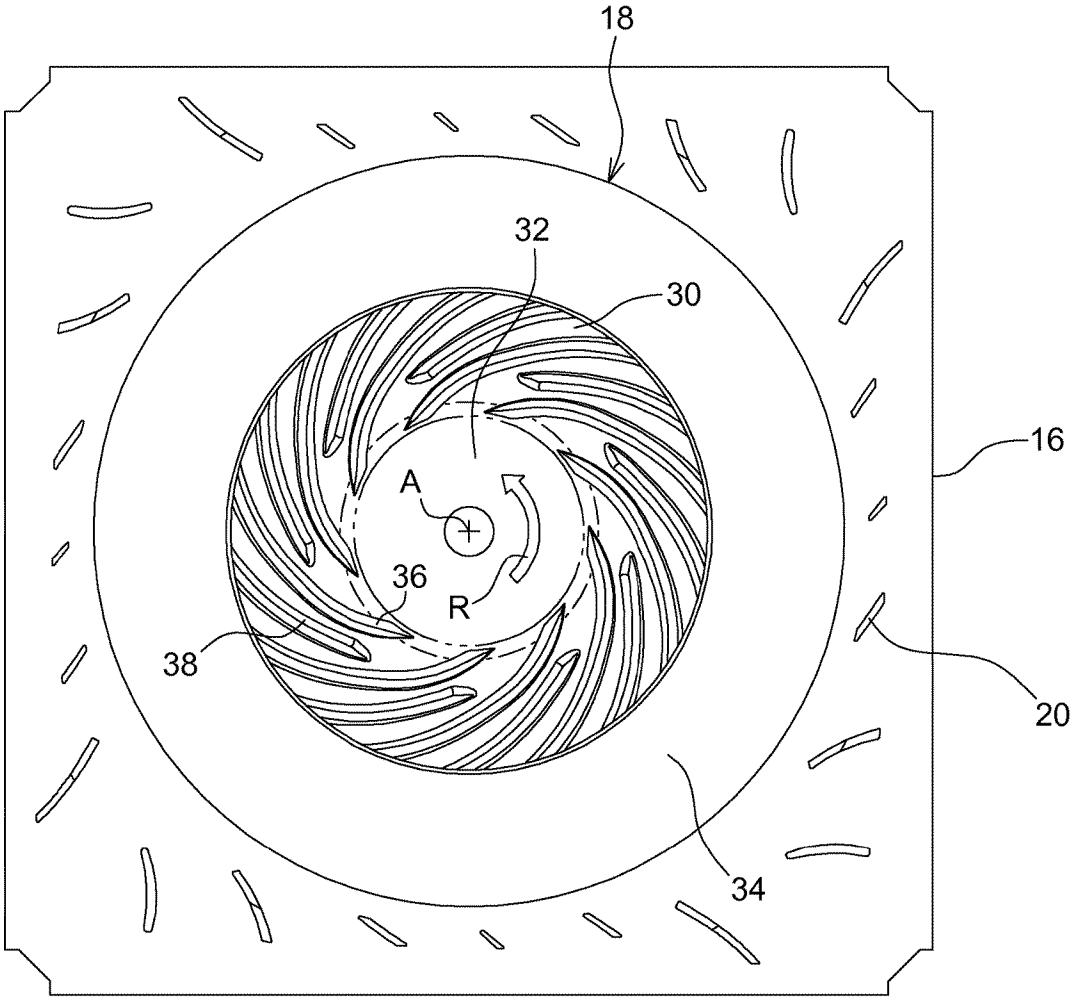
FIG. 2 is a bottom view of the fan assembly of FIG. 1.
Figure 3:
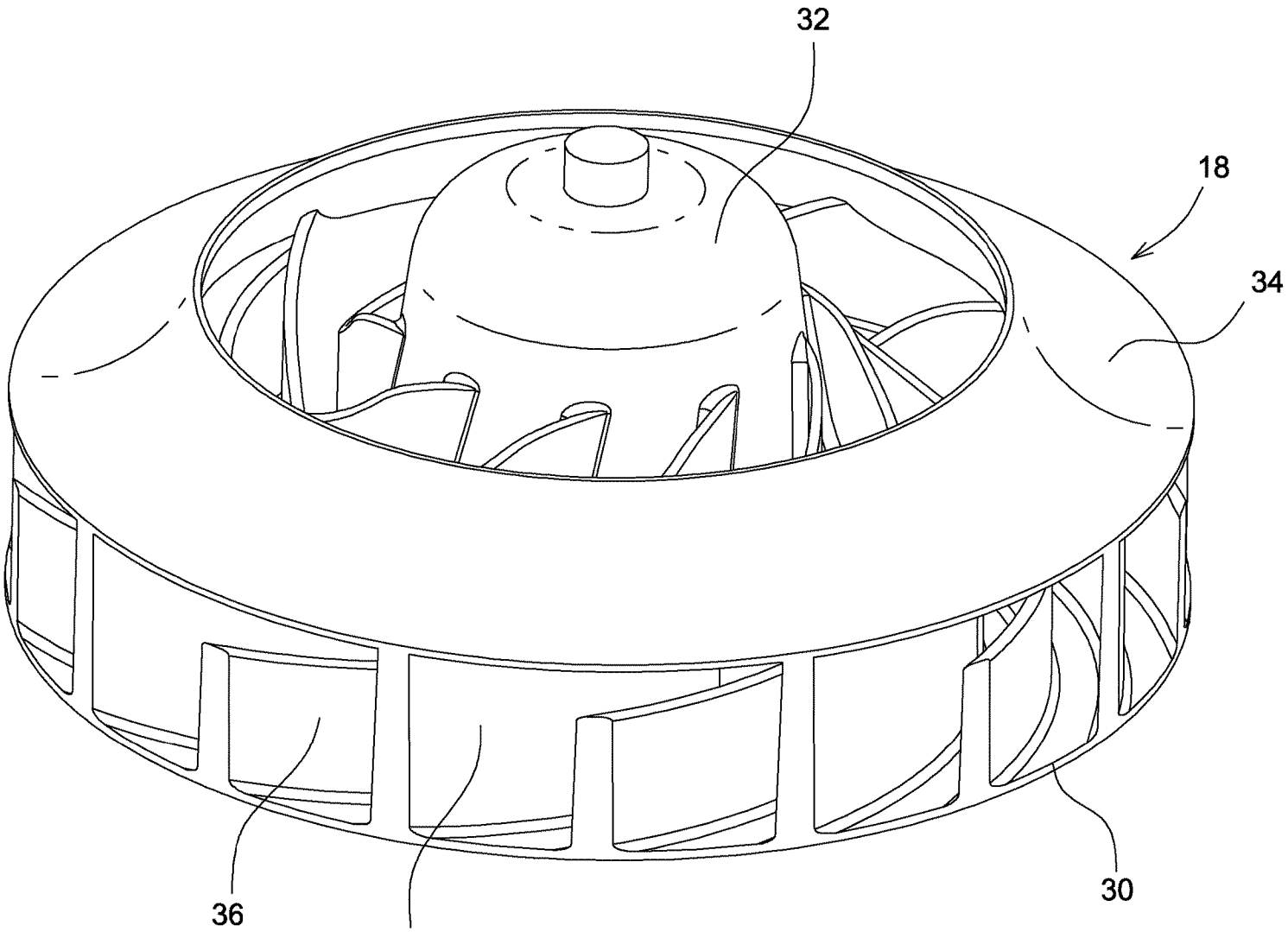
FIG. 3 is a perspective view of the impeller portion of the assembly of FIG. 1.

Referring to FIGS. 1-3, a fan or impeller assembly 10 includes a housing 12 which surrounds a fan unit 14. The fan unit 14 may include a fixed or non-rotating stator 16. The fan unit 14 must include a rotary impeller unit 18. The stator 16 includes a plurality of fins 20 which are positioned and shaped to direct air from the impeller unit 18 out to the conventional heat exchanger modules 22, 24, 26 and 28 of the housing 12.

Figure 4:
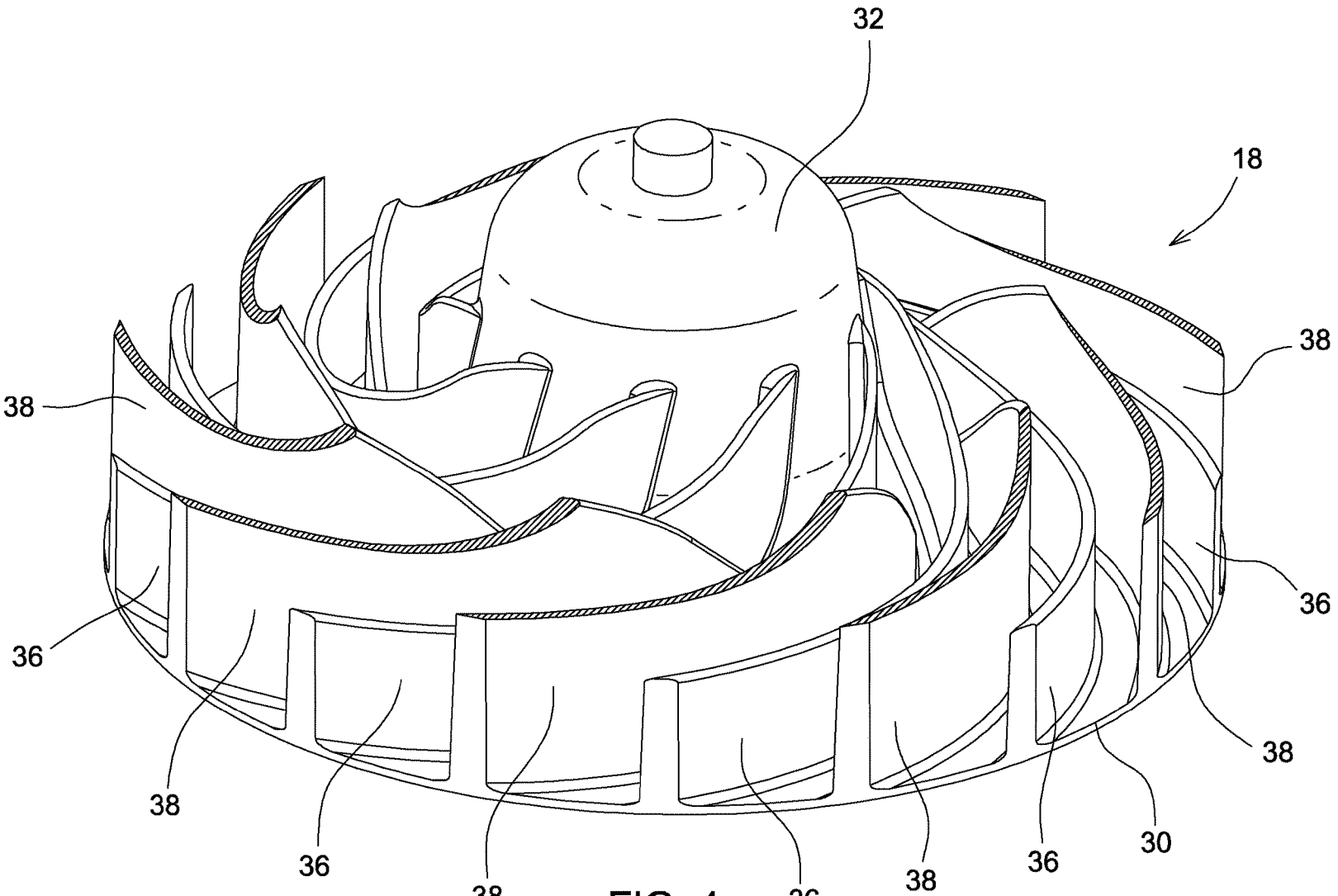
FIG. 4 is a perspective view of the impeller portion of the assembly of FIG. 1 with the inlet ring removed.
Figure 5:
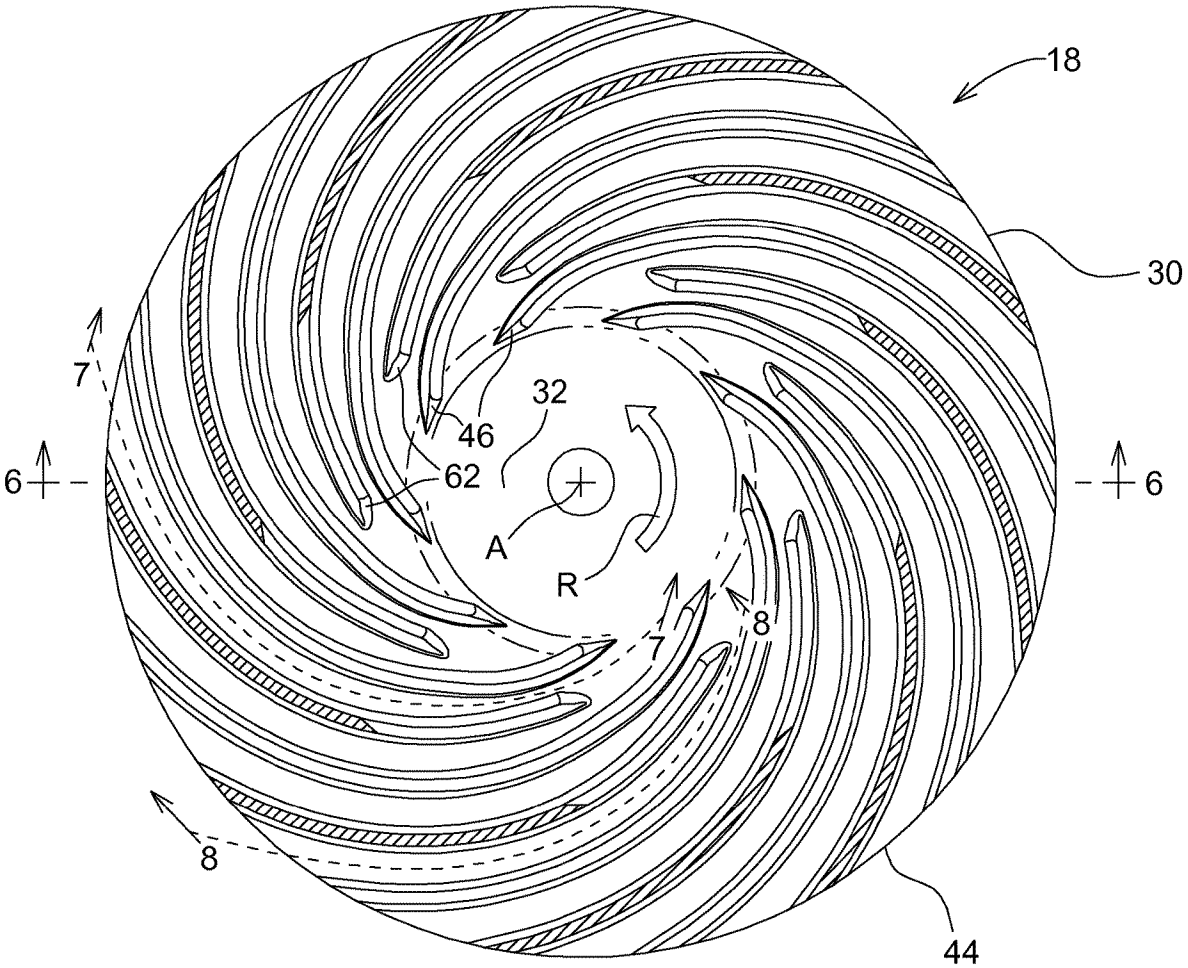
FIG. 5 is a bottom view of the impeller portion of the assembly of FIG. 1 with the inlet ring removed.

As best seen in FIGS. 2-4, the impeller unit 18 includes a base 30, a hub 32, an annular inlet ring 34, a set of first blades 36 and a set of second blades 38. The base 30, hub 32, inlet ring 34, and blades 36 and 38 all rotate together and may be integrally formed. There may be an equal number of first blades 36 and second blades 38. The first blades 36 have a shape or profile which differs from the shape or profile of the second blades 38. As best seen in FIGS. 2 and 5, the impeller unit 18 rotates counterclockwise when viewed from the bottom, and the blades 36 and 38 are backward curved and are concave in a direction opposite to the direction of rotation R about rotation axis A.

Preferably, the number of first blades 36 is the same as the number of second blades 38 so that the fan remains axially balanced. This helps to preserve bearing life and reduce noise. For example, the impeller unit 18 may include 9 first blades 36 and 9 second blades 38 interspersed between them.

Figure 6:
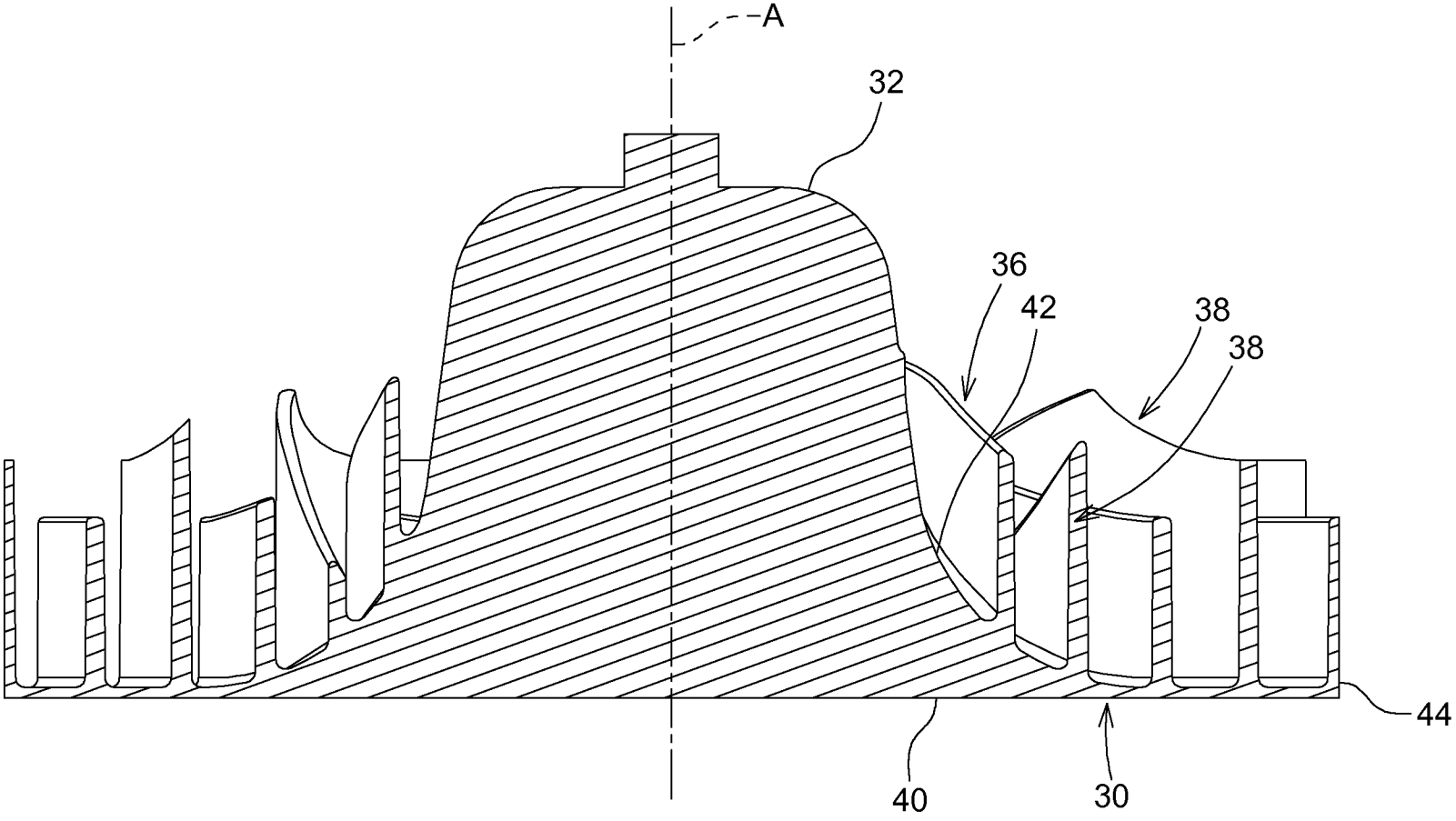
FIG. 6 is a view taken along lines 6-6 of FIG. 5.

As best seen in FIG. 6, the base 30 has a flat side 40 opposite the blades 36, 38. The other side 42 of the base is smoothly curved and transitions smoothly into the outer peripheral surface of the hub 32. The base has an outer edge 44. Each of the blades 36 and 38 defines a curved plane which is parallel to the axis A.

Figure 7:
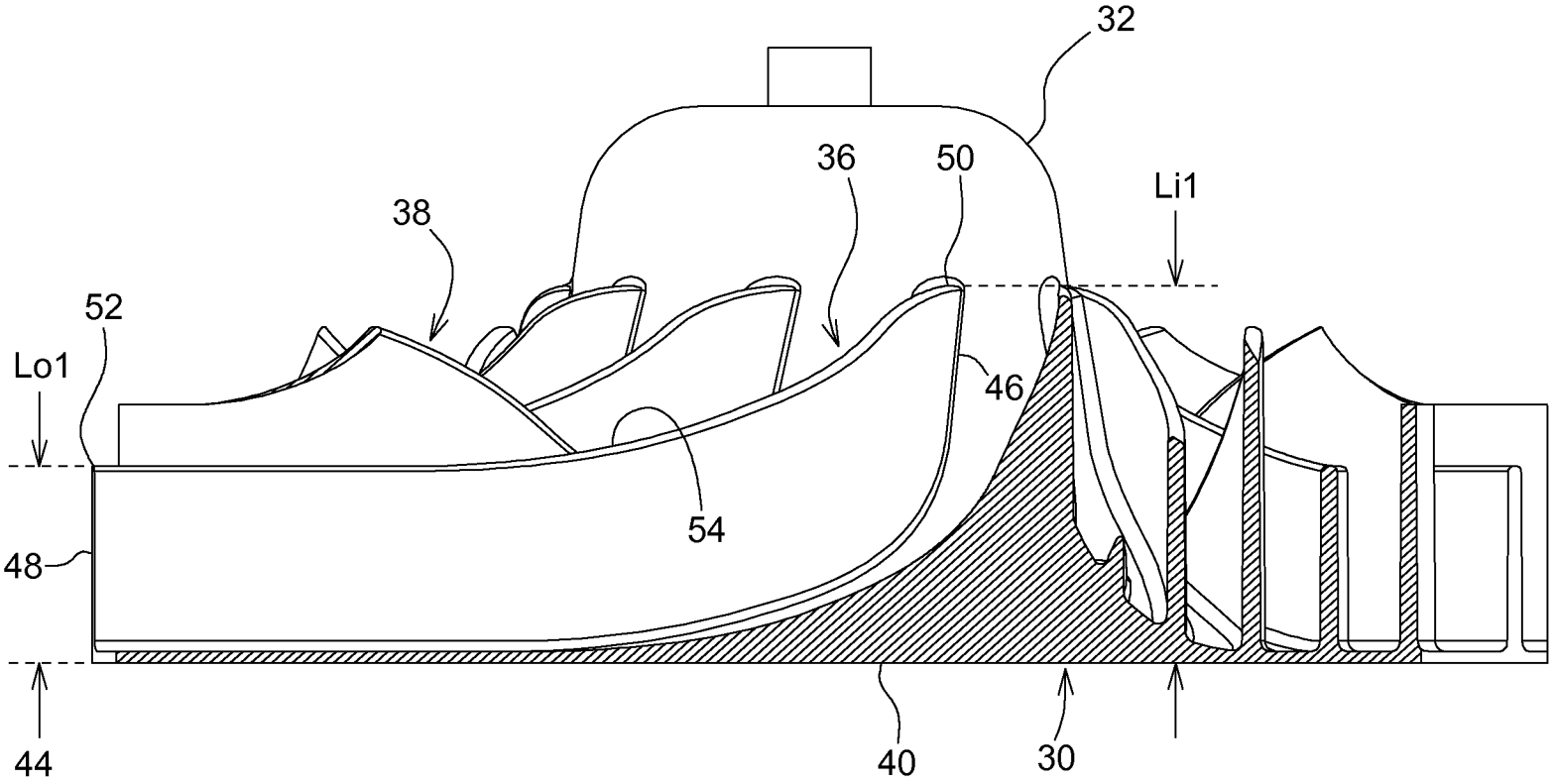
FIG. 7 is a view taken along lines 7-7 of FIG. 5.

As best seen in FIGS. 4, 5 and 7, each first blade 36 has an inner end 46 which is joined to the hub 32 and an outer end 48 which terminates at the outer edge 44 of the base 30. The inner end 46 of each first blade 36 has an upstream corner 50 which is spaced apart axially from the second plate surface 40 by a first inner length Li1. The outer end 48 of each first blade 36 has a downstream corner 52 which is spaced apart axially from the second plate surface 40 by a first outer length Lo1. Each first blade 36 forms an edge 54 which is smoothly curved and which faces away from the base 30.

Figure 8:
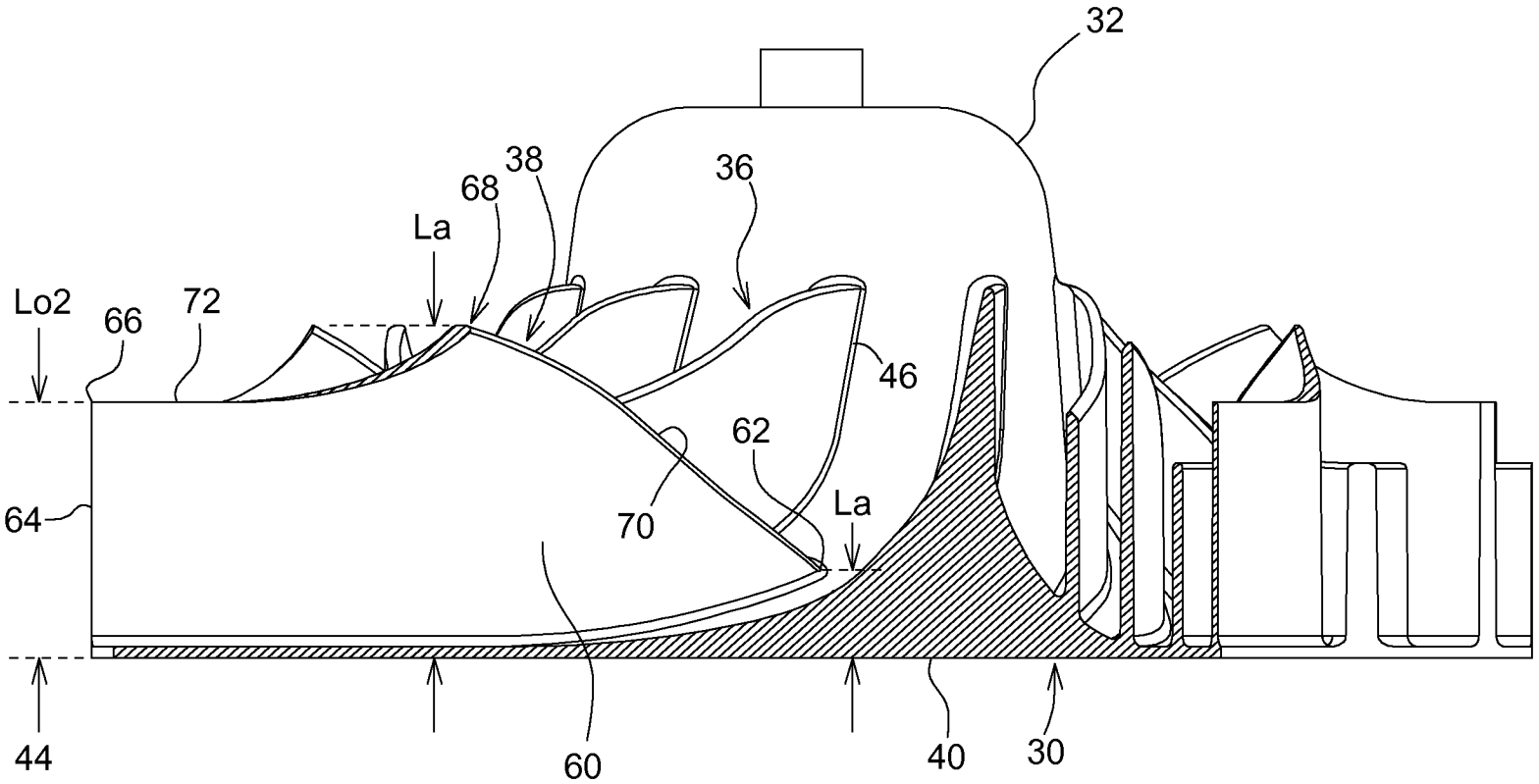
FIG. 8 is a view taken along lines 8-8 of FIG. 5.

As best seen in FIGS. 4, 5 and 8, each second blade 38 has an inner part 60 which tapers to an upstream inner point 62 which is spaced apart radially outwardly from the hub 32 and from the inner ends 46 of the first blades 36. Each second blade 38 also has an outer or downstream end 64 which terminates at the outer edge 44 of the base 30. The point 62 is spaced apart axially from the second plate surface 40 by a second inner length Li2. The outer end 64 of each second blade 38 has a downstream corner 66 which is spaced apart axially from the second plate surface 40 by a second outer length Lo2. The inner part 60 tapers from an apex 68 which is spaced apart axially from the second plate surface 40 by an apex length La. The apex length La is greater than the first outer length Lo1, and is greater than the second outer length Lo2. The apex length La is less than the first inner length Li1. Each second blade 38 forms an inner edge 70 which is smoothly curved and which faces away from the base 30 and which extends from point 62 to apex 68. Each second blade 38 also forms an outer edge 72 which is smoothly curved, which faces away from the base 30 and which extends from apex 68 to corner 66.

The result is a fan or impeller assembly which is quieter. In this design, the height of the fan blades is varied so that a stall condition can be avoided due to the air inlet not being crowded with as many blades, and yet the shorter blades still contribute to the overall flow volume produced. This fan assembly generates an improved vertical air distribution on the outlet. For the air traveling through the heat exchangers surrounding the fan, better heat transfer is achieved with consistent airflow across the whole face of each heater exchanger. Airflow distribution is more even.

While the above describes example embodiments of the present disclosure, these descriptions should not be viewed in a limiting sense. Rather, there are several variations and modifications which may be made without departing from the scope of the present invention as defined in the appended claims.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. An impeller comprising:

a base plate having an outer edge;

a hub connected to the base plate and having a rotation axis;

a plurality of first blades disposed on the base plate;

a plurality of second blades disposed on the base plate, each of the first blades being spaced apart and positioned between a corresponding pair of second blades, each first blade having an inner end connected to the hub and having a first inner axial length, each first blade having an outer end spaced apart from the hub and extending to the outer edge and having a first outer axial length which is less than the first inner axial length, each second blade having an inner end which is spaced apart from the hub, and each second blade having an outer end spaced apart from the hub and extending to the outer edge, said second blade outer end having a second outer axial length which is greater than the first outer axial length; and an annular inlet ring coupled to the second blades.

2. The impeller of claim 1, wherein:

each inner end of the plurality of second blades tapers to a tip connected to the base plate.

3. The impeller of claim 1, wherein the outer ends of the first and second blades are aligned with said outer peripheral edge.

4. The impeller of claim 1, wherein:

each second blade has an apex at a mid location which is between the inner and outer ends thereof, said apex having an axial length which greater than a second inner axial length and the second outer axial length and less than the first inner axial length.

5. The impeller of claim 1, wherein:

the base plate has a curved first plate surface from which the blades project, and the base plate having a flat second plate surface opposite the first plate surface; and the inner end of each first blade has an upstream corner which is spaced apart axially from the second plate surface by a first inner length;

each second blade has a mid location which is between the inner end and outer ends thereof, each mid location forming an apex which is spaced apart axially from the second plate surface by an apex axial length, said first inner axial length being greater than said apex axial length.

6. An impeller comprising:

a base plate;

a hub connected to the base plate, the base plate having an outer peripheral edge;

a plurality of first blades disposed on the base plate, each first blade having an inner end connected to the hub at a first inner axial length and having a first profile, each first blade having an outer end which terminates at said outer peripheral edge and has a first outer axial length;

a plurality of second blades disposed on the base plate, each of the first blades being spaced apart and positioned between a corresponding pair of second blades, each second blade having an inner end which is spaced radially outwardly with respect to the inner ends of the first blades and spaced a second inner axial length, the second inner axial length being less than the first inner axial length and each second blade having a second profile which differs from said first profile, and each second blade having an outer end which terminates at said outer peripheral edge said second blade outer end having a second outer axial length which is greater than the first outer axial length; and an annular inlet ring coupled to the second blades.

7. The impeller of claim 6, wherein:

the inner end of each second blade tapers to a tip connected to the base plate.

8. The impeller of claim 6, wherein:

the base plate has a curved first plate surface from which the blades project, and the base plate having a flat second plate surface opposite the first plate surface; and each second blade has a mid location which is between the inner end and outer ends thereof, each mid location forming an apex which is spaced apart axially from the second plate surface by an apex axial length, said first inner axial length being greater than said apex axial length.

9. An fan assembly comprising:

a base plate having an outer peripheral edge and a plate surface;

a hub connected to the base plate and having a rotation axis;

a plurality of backward curved first blades connected to the hub and to the base plate, each first blade extending outwardly to said outer peripheral edge;

a plurality of backward curved second blades connected to the base plate and spaced apart from the hub, each of the first blades being spaced apart and positioned between a corresponding pair of second blades, each second blade extending outwardly to said outer peripheral edge;

an annular inlet ring coupled to the second blades;

a first outer end defined by each first blade and spaced apart from the hub, said first outer end having a first outer axial length;

a second outer end defined by each second blade and spaced apart from the hub, said second outer end and having a second outer axial length which is greater than the first outer axial length;

an inner end of each first blade having an upstream corner which is spaced apart axially from the plate surface by a first inner length; and an apex defined in each second blade defined between an inner end and an outer end thereof, each apex spaced apart axially from the plate surface by an apex axial length;

wherein, the first inner axial length is greater than said apex axial length;

further wherein, the annular inlet ring is coupled to the second blades between the apex and the second outer end.

10. The fan assembly of claim 9, further wherein the annular inlet ring extends axially away from the apex.

11. The fan assembly of claim 9, further comprising a stator surrounding the base plate.

12. The fan assembly of claim 11, further comprising a plurality of fins positioned and shaped to direct air from the first blades and the second blades out to a conventional heat exchanger module.

* * * * *